US007976118B2

(12) United States Patent
Fairchild et al.

(10) Patent No.: US 7,976,118 B2
(45) Date of Patent: Jul. 12, 2011

(54) TRANSPORT SYSTEM FOR PROVIDING A CONTINUOUS SUPPLY OF SOLID INK TO A MELTING ASSEMBLY IN A PRINTER

(75) Inventors: Michael Alan Fairchild, Vancouver, WA (US); Michael Kenneth Oehl, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 864 days.

(21) Appl. No.: 11/975,856

(22) Filed: Oct. 22, 2007

(65) Prior Publication Data

US 2009/0102905 A1 Apr. 23, 2009

(51) Int. Cl.
*B41J 2/195* (2006.01)
*B41J 2/175* (2006.01)

(52) U.S. Cl. ..... 347/19; 347/7; 347/88; 347/99

(58) Field of Classification Search ..... 347/7, 9, 347/19, 88, 99
See application file for complete search history.

(56) References Cited

U.S. PATENT DOCUMENTS

| | | | | |
|---|---|---|---|---|
| 3,773,069 | A | | 11/1973 | Rebentisch |
| 4,593,292 | A | * | 6/1986 | Lewis ..... 347/88 |
| 4,636,803 | A | | 1/1987 | Mikalsen |
| 4,682,187 | A | | 7/1987 | Martner |
| 5,123,961 | A | | 6/1992 | Yamamoto |
| 5,181,049 | A | | 1/1993 | Mackay et al. |
| 5,223,860 | A | | 6/1993 | Loofbourow et al. |
| 5,276,468 | A | | 1/1994 | Deur et al. |
| 5,341,164 | A | | 8/1994 | Miyazawa et al. |
| 5,379,915 | A | | 1/1995 | Hudspeth et al. |
| 5,386,224 | A | | 1/1995 | Deur et al. |
| 5,442,387 | A | | 8/1995 | Loofbourow et al. |
| 5,510,821 | A | | 4/1996 | Jones et al. |
| D371,157 | S | | 6/1996 | Chambers |

(Continued)

FOREIGN PATENT DOCUMENTS

EP 0683051 A2 11/1995

(Continued)

OTHER PUBLICATIONS

Non-Final Office Action for U.S. Appl. No. 11/602,931, Mailed Jun. 9, 2009, United States Patent and Trademark Office (21 pages).

(Continued)

*Primary Examiner* — Matthew Luu
*Assistant Examiner* — Rut Patel
(74) *Attorney, Agent, or Firm* — Maginot, Moore & Beck LLP

(57) ABSTRACT

A solid ink printer includes a solid ink transportation control system that helps ensure a continuous supply of solid ink to a melting device within a printer. The solid ink transportation control system includes an ink loss measurement circuit configured to identify an accumulated ink mass loss of ink from an ink reservoir in a printer and to generate an ink supply replenish signal in response to the accumulated ink mass loss reaching an accumulated loss threshold, a drive motor electrically coupled to the ink loss measurement circuit, the drive motor being configured to operate in response to the ink supply replenish signal, and an ink stick drive train coupled to the drive motor, at least a portion of the ink stick drive train moving towards a melting assembly in the printer in response to the operation of the drive motor.

9 Claims, 2 Drawing Sheets

U.S. PATENT DOCUMENTS

D371,801 S 7/1996 Jones et al.
D371,802 S 7/1996 Jones et al.
D372,268 S 7/1996 Jones et al.
D372,270 S 7/1996 Jones et al.
D373,139 S 8/1996 Jones et al.
D379,470 S 5/1997 Gilbert
D379,471 S 5/1997 Gilbert
D379,639 S 6/1997 Gilbert
D379,640 S 6/1997 Gilbert
D380,771 S 7/1997 Jones
D383,153 S 9/1997 Jones et al.
D383,154 S 9/1997 Jones et al.
5,689,288 A 11/1997 Wimmer et al.
5,734,402 A 3/1998 Rousseau et al.
5,784,089 A 7/1998 Crawford
D402,308 S 12/1998 Yao et al.
D403,351 S 12/1998 Yao et al.
D403,352 S 12/1998 Brown et al.
D403,699 S 1/1999 Chin et al.
5,861,903 A 1/1999 Crawford et al.
D407,109 S 3/1999 Yao et al.
D407,110 S 3/1999 Yao et al.
D407,111 S 3/1999 Brown et al.
D407,742 S 4/1999 Yao et al.
D407,743 S 4/1999 Yao et al.
D407,745 S 4/1999 Brown et al.
D408,849 S 4/1999 Chin et al.
D409,235 S 5/1999 Chin et al.
D409,237 S 5/1999 Ellers et al.
D410,026 S 5/1999 Brown et al.
D410,490 S 6/1999 Mattern et al.
5,917,528 A 6/1999 Grellmann et al.
D412,527 S 8/1999 Ellers et al.
D412,528 S 8/1999 Ellers et al.
D412,934 S 8/1999 Jones
D413,625 S 9/1999 Brown et al.
D414,200 S 9/1999 Jones
D415,193 S 10/1999 Jones
D416,936 S 11/1999 Chin et al.
5,975,690 A * 11/1999 Grellmann et al. ..... 347/88
5,988,805 A 11/1999 Meinhardt
6,053,608 A 4/2000 Ishii et al.
6,056,394 A 5/2000 Rousseau et al.
6,089,686 A * 7/2000 Thornton et al. ..... 347/7
6,109,803 A 8/2000 Yasui et al.
D436,124 S 1/2001 Mattern et al.
D436,989 S 1/2001 Mattern et al.
6,170,942 B1 1/2001 Ogawa et al.
D440,248 S 4/2001 Mattern et al.
D440,249 S 4/2001 Ellers et al.
6,334,658 B1 * 1/2002 Suzuki ..... 347/7
D453,786 S 2/2002 Mattern
D453,787 S 2/2002 Mattern
6,422,694 B1 7/2002 Hollands
6,543,867 B1 4/2003 Jones
6,561,636 B1 5/2003 Jones
6,565,200 B1 5/2003 Jones
6,565,201 B1 5/2003 Jones
6,572,225 B1 6/2003 Jones
D478,347 S 8/2003 Jones
D478,621 S 8/2003 Jones
D479,368 S 9/2003 Jones
D481,757 S 11/2003 Jones
D481,758 S 11/2003 Jones
D481,759 S 11/2003 Jones et al.
D482,062 S 11/2003 Jones
D482,063 S 11/2003 Jones et al.
D482,388 S 11/2003 Jones
D482,389 S 11/2003 Jones
D482,720 S 11/2003 Jones et al.
D482,721 S 11/2003 Jones
D482,722 S 11/2003 Jones
6,648,435 B1 11/2003 Jones
D483,062 S 12/2003 Jones
D483,063 S 12/2003 Jones
D483,404 S 12/2003 Jones et al.
6,672,716 B2 1/2004 Jones
6,679,591 B2 1/2004 Jones
6,705,710 B2 3/2004 Jones
6,709,094 B2 3/2004 Jones
6,719,413 B2 4/2004 Jones
6,719,419 B2 4/2004 Jones et al.
6,722,764 B2 4/2004 Jones et al.
6,739,713 B2 5/2004 Jones et al.
6,746,113 B1 6/2004 Leighton et al.
6,755,517 B2 6/2004 Jones et al.
6,761,443 B2 7/2004 Jones
6,761,444 B2 7/2004 Jones et al.
6,824,241 B2 11/2004 Sonnichsen et al.
D500,784 S 1/2005 Jones et al.
D500,785 S 1/2005 Jones et al.
6,840,612 B2 1/2005 Jones et al.
6,840,613 B2 1/2005 Jones
6,857,732 B2 2/2005 Jones et al.
6,866,375 B2 3/2005 Leighton
6,874,880 B2 4/2005 Jones
6,893,121 B2 5/2005 Jones
6,895,191 B2 5/2005 Rommelmann et al.
D505,974 S 6/2005 Jones et al.
6,905,201 B2 6/2005 Leighton
6,929,360 B2 8/2005 Jones
6,966,644 B2 11/2005 Jones et al.
6,981,754 B2 1/2006 Godil et al.
6,986,570 B2 1/2006 Jones et al.
7,063,412 B2 6/2006 Jones et al.
7,066,589 B2 6/2006 Jones et al.
D524,370 S 7/2006 Jones et al.
7,104,635 B2 9/2006 Jones
D531,210 S 10/2006 Jones
D533,900 S 12/2006 Jones et al.
D535,327 S 1/2007 Korn et al.
D535,689 S 1/2007 Jones et al.
D537,116 S 2/2007 Jones et al.
7,780,284 B2 * 8/2010 Fairchild et al. ..... 347/88
7,798,624 B2 * 9/2010 Fairchild et al. ..... 347/88
2002/0140748 A1 * 10/2002 Kanaya et al. ..... 347/7
2003/0202066 A1 10/2003 Jones
2003/0202067 A1 10/2003 Jones et al.
2003/0202069 A1 10/2003 Jones
2003/0202070 A1 10/2003 Jones
2003/0202071 A1 10/2003 Jones et al.
2003/0202074 A1 10/2003 Jones
2003/0202075 A1 10/2003 Jones
2003/0202077 A1 10/2003 Jones et al.
2003/0222930 A1 12/2003 Jones
2003/0222951 A1 12/2003 Jones
2003/0222952 A1 12/2003 Jones
2003/0222953 A1 12/2003 Jones
2003/0222954 A1 12/2003 Jones et al.
2003/0222955 A1 12/2003 Jones
2004/0056910 A1 * 3/2004 Usui et al. ..... 347/7
2004/0160498 A1 8/2004 Jones
2004/0179074 A1 9/2004 Jones et al.
2004/0183875 A1 9/2004 Jones et al.
2005/0007428 A1 1/2005 Joppen
2005/0063820 A1 3/2005 Awdalla
2005/0128230 A1 * 6/2005 Chelvayohan ..... 347/7
2005/0146584 A1 7/2005 Godil et al.
2005/0151814 A1 7/2005 Wong et al.
2006/0227193 A1 10/2006 Leighton
2007/0153068 A1 7/2007 Jones et al.
2008/0117264 A1 5/2008 Fairchild et al.
2008/0117265 A1 5/2008 Esplin et al.
2008/0117266 A1 5/2008 Esplin et al.
2008/0117267 A1 5/2008 Fairchild et al.
2008/0122907 A1 5/2008 Jones
2008/0136881 A1 6/2008 Fairchild et al.
2008/0136882 A1 6/2008 Fairchild et al.
2008/0218572 A1 9/2008 Fairchild et al.

FOREIGN PATENT DOCUMENTS

EP 1122075 A1 8/2001
EP 1359019 A1 11/2003
JP 11115213 A 4/1994

OTHER PUBLICATIONS

Amendment in Response to Non-Final Office Action for U.S. Appl. No. 11/602,931, submitted Sep. 8, 2009 (17 pages).
Final Office Action for U.S. Appl. No. 11/602,931, Mailed Jan. 5, 2010, United States Patent and Trademark Office (21 pages).
Amendment accompanying a Request for Continued Examination for U.S. Appl. No. 11/602,931, submitted Apr. 5, 2010 (9 pages).
Second Non-Final Office Action for U.S. Appl. No. 11/602,931, Mailed Jun. 22, 2010, United States Patent and Trademark Office (9 pages).
Amendment in Response to Second Non-Final Office Action for U.S. Appl. No. 11/602,931, submitted Aug. 23, 2010 (5 pages).
Non-Final Office Action for U.S. Appl. No. 11/602,937, Mailed Sep. 21, 2009, United States Patent and Trademark Office (7 pages).
Amendment in Response to Non-Final Office Action for U.S. Appl. No. 11/602,937, submitted Dec. 21, 2009 (8 pages).
Final Office Action for U.S. Appl. No. 11/602,937, Mailed Apr. 14, 2010, United States Patent and Trademark Office (8 pages).
Amendment accompanying a Request for Continued Examination for U.S. Appl. No. 11/602,937, submitted Apr. 23, 2010 (9 pages).
Non-Final Office Action for U.S. Appl. No. 11/602,710, Mailed Aug. 11, 2009, United States Patent and Trademark Office (7 pages).
Amendment in Response to Non-Final Office Action for U.S. Appl. No. 11/602,710, submitted Nov. 12, 2009 (13 pages).
Final Office Action for U.S. Appl. No. 11/602,710, Mailed Mar. 5, 2010, United States Patent and Trademark Office (7 pages).
Amendment accompanying a Request for Continued Examination for U.S. Appl. No. 11/602,710, submitted Apr. 23, 2010 (5 pages).
Second Non-Final Office Action for U.S. Appl. No. 11/602,710, Mailed May 13, 2010, United States Patent and Trademark Office (8 pages).
Amendment in Response to Second Non-Final Office Action for U.S. Appl. No. 11/602,710, submitted Jul. 13, 2010 (6 pages).
Non-Final Office Action for U.S. Appl. No. 11/602,938, Mailed Aug. 7, 2009, United States Patent and Trademark Office (10 pages).
Amendment in Response to Non-Final Office Action for U.S. Appl. No. 11/602,938, submitted Sep. 2, 2009 (29 pages).
Non-Final Office Action for U.S. Appl. No. 11/602,943 Mailed Jun. 25, 2009, United States Patent and Trademark Office (7 pages).
Amendment in Response to Non-Final Office Action for U.S. Appl. No. 11/602,943, submitted Sep. 24, 2009 (13 pages).
Final Office Action for U.S. Appl. No. 11/602,943 Mailed Jan. 21, 2010, United States Patent and Trademark Office (9 pages).
Amendment accompanying a Request for Continued Examination for U.S. Appl. No. 11/602,943, submitted Mar. 22, 2010 (10 pages).
Second Non-Final Office Action for U.S. Appl. No. 11/602,943 Mailed Apr. 14, 2010, United States Patent and Trademark Office (5 pages).
Amendment in Response to second Non-Final Office Action for U.S. Appl. No. 11/602,943, submitted Apr. 23, 2010 (10 pages).
Non-Final Office Action for U.S. Appl. No. 12/016,675 Mailed May 10, 2010, United States Patent and Trademark Office (10 pages).
Amendment in Response to Non-Final Office Action for U.S. Appl. No. 12/016,675, submitted Jul. 12, 2010 (7 pages).
Supplemental International Search Report in corresponding European Application No. 07120873.0 mailed May 19, 2008 (9 pages).
International Search Report in corresponding European Application No. 07120873.0 mailed Mar. 4, 2008 (5 pages).
International Search Report in corresponding European Application No. 07120975.3 mailed Mar. 14, 2008 (5 pages).
Final Office Action for U.S. Appl. No. 12/016,675, Mailed Sep. 28, 2010, United States Patent and Trademark Office (10 pages).
Amendment in Response to Final Office Action for U.S. Appl. No. 12/016,675, submitted Oct. 15, 2010 (10 pages).
Final Office Action for U.S. Appl. No. 11/602,710, Mailed Sep. 30, 2010, United States Patent and Trademark Office (7 pages).
Amendment in Response to Final Office Action for U.S. Appl. No. 11/602,710, submitted Oct. 27, 2010 (6 pages).
Final Office Action for U.S. Appl. No. 11/602,931, Mailed Nov. 15, 2010, United States Patent and Trademark Office (8 pages).
Amendment Accompanying a Request for Continued Examination for U.S. Appl. No. 11/602,931, submitted Jan. 18, 2011 (7 pages).

* cited by examiner

TRANSPORT SYSTEM FOR PROVIDING A CONTINUOUS SUPPLY OF SOLID INK TO A MELTING ASSEMBLY IN A PRINTER

CROSS-REFERENCE TO RELATED APPLICATIONS

Cross reference is made to the following applications: U.S. patent application Ser. No. 11/602,931, which is entitled "Printer Solid Ink Transport and Method", U.S. patent application Ser. No. 11/602,937, which is entitled "Guide For Printer Solid Ink Transport and Method", U.S. patent application Ser. No. 11/602,710, which is entitled "Solid Ink Block Features for Printer Ink Transport and Method", and U.S. patent application Ser. No. 11/602,938, which is entitled "Transport System for Solid Ink for Cooperation with Melt Head in a Printer", all of which were filed on Nov. 21, 2006, and all of which are expressly incorporated in their entireties herein by reference.

TECHNICAL FIELD

The transport control system disclosed below generally relates to solid ink printers, and, more particularly, to solid ink printers that use mechanized drives to move solid ink units to a melting assembly.

BACKGROUND

Solid ink or phase change ink printers encompass various imaging devices, such as printers and multi-function platforms. Solid ink printers offer many advantages over other types of image generating devices, such as laser and aqueous inkjet approaches. These advantages include higher document throughput, sharp colors, and less packaging waste for the ink consumed by the printer.

A typical solid ink imaging device includes an ink loader, which receives solid ink units, such as ink sticks or pellets. These ink units remain solid at room temperatures so a user can conveniently store solid ink in proximity to a device and handle the solid ink during the loading phase without mess or staining. Coupled to the ink loader is a feed channel through which multiple units of the solid ink may be transported for delivery to a melting assembly. Thus, the ink is loaded by a user in solid form into the ink loader and then the solid ink is moved into the feed channel for delivery to the melting assembly. In most color solid ink imaging devices, a plurality of ink loaders are provided, one for each color of ink used in the device. Coupled to each ink loader is a feed channel for delivering the solid ink from an ink loader for a particular color to a melting assembly for that color. These multiple ink loaders, feed channels, and melting assemblies are typically provided in parallel in the imaging device.

Movement of the solid ink from the ink loader to the feed channel has been previously performed in a variety of ways. In some solid ink printers, the loader includes an insertion port at an upper end of a feed channel. An ink stick is placed in the port so that at least a portion of the ink stick engages a mechanized drive, such as an endless belt mounted around driven pulleys. As the pulleys are driven by a motive force, such as an electrical motor with a rotational output shaft, the belt transports the ink stick along the feed channel. The feed channel may terminate in a nearly vertical section. The end of the looped belt furthest from the insertion port is proximate the vertical section. As the ink stick leaves the driven endless belt, it transitions to a vertical orientation so gravity pulls the ink stick to the bottom of the feed channel against a melting assembly. The melting assembly causes the solid ink to change phase and be collected in a reservoir for use in the printer.

Solid ink or phase change printers differ from ink cartridge or toner printers because the colorant supply is manually manipulated by the user and the supply need not be exhausted before the supply is renewed. Specifically, ink cartridges and toner cartridges require exhaustion because they are storage containers that cannot be refilled by the user. Instead, the cartridges are typically returned to the manufacturing source to be refilled. Solid ink, on the other hand, may be stored on the premises and installed a unit at a time into the imaging device. Because the entire solid ink unit is consumed in the printing process, no housing or other component survives for return to the manufacturer.

The requirement that the solid ink units remain solid until they impinge upon the melting assembly does present some challenges not present in the ink cartridge and toner cartridge printers. While the ink loader is essentially within the ambient room temperature environment, the melting assembly is elevated above this temperature to one that causes the solid ink unit to change phase. Typically, the melting assembly is located within the interior of the printer, while the ink loader is located at the exterior of the printer so the user can access the loader. After the solid ink is inserted, it then needs to be transported from the loader to the melting assembly.

In the loading systems that include a mechanized drive and a gravity fed section, the feed channel can appear full to a user when the feed channel has gaps between the ink sticks. This situation is depicted in FIG. 1. As shown in the figure, a curved feed channel 14 includes an endless belt 18 mounted around pulleys 20 at least some of which are driven by a motor and gear train 22 or the like. An ink stick 26 placed in the port 24 engages the belt 18 and is carried along the feed channel 14 in response to the pulleys 20 being driven. After transitioning through the curve 28, the ink stick begins a fall towards a melting assembly 30. As shown in FIG. 1, a stack of ink sticks may develop in the gravity fed portion of the feed channel 14. The weight of these sticks help urge the bottommost stick against the melting assembly for more efficient melting.

In order to sense the presence of ink sticks in the vertical section of the feed channel 14, one or more mechanical flags may be provided. As shown in FIG. 1, a low ink flag 36 is positioned near the end of the transition section and an out of ink flag 40 is positioned near the melting assembly. The mechanical flag may be a finger that is biased to move into the ink stick path. An ink stick moving through the feed channel 14, however, urges the flag against the biasing action to displace the flag from its path as it passes a flag. The presence of the flag may be electrically sensed to generate a signal that indicates whether an ink stick is acting on a flag or not. For example, if the low ink flag indicates no ink stick is acting on it to move it out of the ink stick path, then a signal is generated that indicates only a number of ink sticks corresponding to the length of feed channel below the low flag to the melting assembly may be present in the feed channel. Similarly, if no ink stick is acting on the out flag, then an insufficient amount of ink stick is in the vertical portion of the feed channel to provide a reliable supply of solid ink to the melting assembly for use in the printer. In response to the signal generated from the low flag or out flag indicating no ink stick is opposite the flag, a controller in the printer may activate the motive force to the pulleys 20 to transport ink sticks to the vertical section of the feed channel to replenish the stack of ink sticks against the melting assembly.

As shown in FIG. 1, waiting for a signal to be generated in response to the flags may result in a gap G between the sticks in the vertical section of the feed channel and the sticks near the insertion port. In response to the ink low or ink out signals, the motive force drives the belt until one or both of the signals change state to indicate a solid ink stick is opposite the flag. The delay between the flag changing state and the motive force being stopped may result in the belt rotating against one or more ink sticks that cannot move because the vertical section has been filled. This rotation against a stationary ink stick may produce some debris in the feed channel. This debris is solid ink that is lost to the ink supply process. Also, as ink sticks are driven to the transition section of the feed channel, the fall through the vertical space caused by the gap may also cause collisions between ink sticks that also result in solid ink being lost to the ink supply process. Consequently, a solid ink stick transportation system that provides a continuous supply of solid ink to the melting assembly and leaves the gap at the insertion port where the user can view it is desirable.

SUMMARY

A solid ink printer includes a solid ink transportation control system that helps ensure a continuous supply of solid ink to a melting device within a printer. The solid ink transportation control system includes an ink loss measurement circuit configured to identify an accumulated ink mass loss of ink from an ink reservoir in a printer and to generate an ink supply replenish signal in response to the accumulated ink mass loss reaching an accumulated loss threshold, a drive motor electrically coupled to the ink loss measurement circuit, the drive motor being configured to operate in response to the ink supply replenish signal, and an ink stick drive train coupled to the drive motor, at least a portion of the ink stick drive train moving towards a melting assembly in the printer in response to the operation of the drive motor.

A printer having multiple print heads may use multiple ink stick transportation control systems to help ensure a continuous supply of solid ink to each print head in the printer. The printer includes a plurality of feed channels, each feed channel having an ink stick insertion end, an ink stick delivery end, and an ink stick drive train to transport ink sticks from the ink stick insertion end to the ink stick delivery end, the ink stick drive train including a drive motor, a plurality of melting assemblies, each melting assembly being located to receive ink sticks from one of the feed channels, a plurality of melted ink reservoirs, each melted ink reservoir being coupled to one of the melting assemblies to receive melted ink from the one melting assembly to which the melted ink reservoir is coupled, a plurality of ink loss measurement circuits, each ink loss measurement circuit being configured to identify an accumulated ink mass loss of ink from one of the melted ink reservoirs and to generate an ink supply replenish signal in response to the accumulated ink mass loss reaching an accumulated threshold, the ink supply replenish signal being coupled to the drive motor of the ink stick drive train for the feed channel that provides ink sticks to the melting assembly that supplies melted ink to the melted ink reservoir for which the ink loss measurement circuit identified an accumulated ink mass loss.

BRIEF DESCRIPTION OF THE DRAWINGS

Features for controlling the transportation of solid ink in a solid ink printer are discussed with reference to the drawings, in which.

DETAILED DESCRIPTION

The term "printer" refers, for example, to reproduction devices in general, such as printers, facsimile machines, copiers, and related multi-function products. While the specification focuses on a system that transports solid ink through a solid ink printer with a mechanized drive train, the transport control system may be used with solid ink image generating devices that use other solid ink supply methods.

Figure 1:
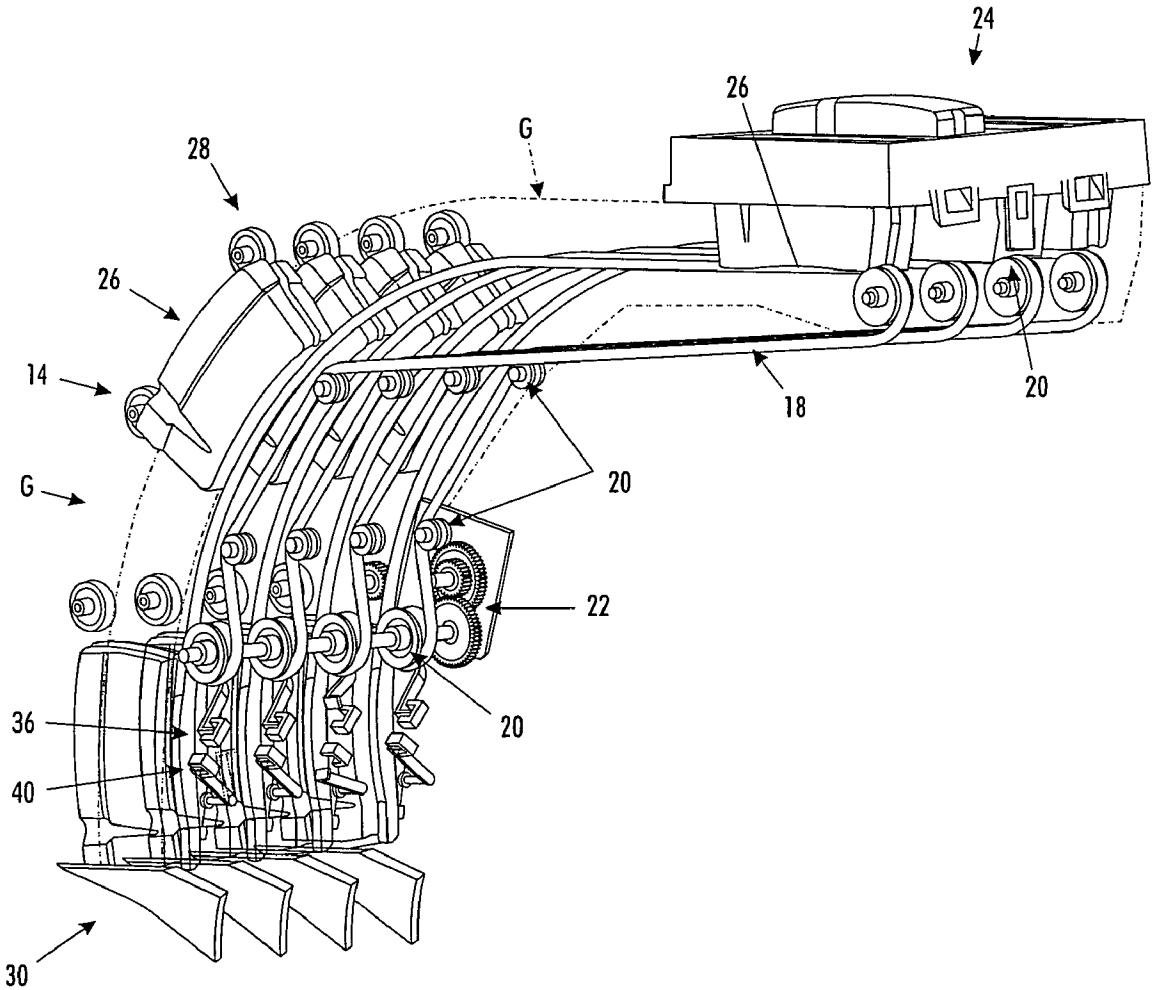
FIG. 1 is a perspective view of a prior art solid ink printer depicting a gap in the solid ink supply to a melting device in the printer.
Figure 2:
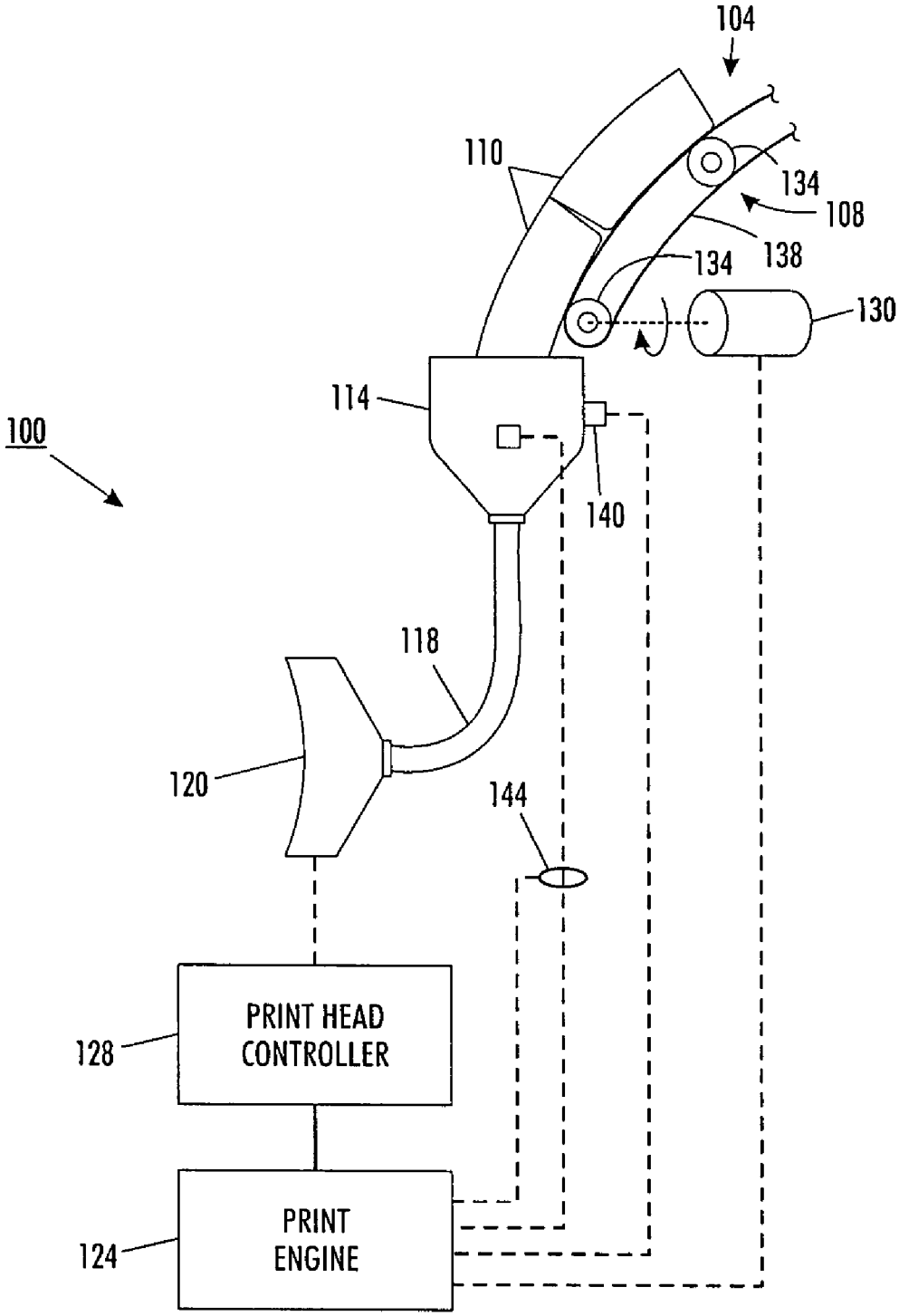
FIG. 2 is a block diagram of multiple embodiments of an ink loss measurement circuit used to control the ink stick transportation control system to help ensure a continuous supply of solid ink sticks are provided to a melting device.

A system for controlling transportation of solid ink in a solid ink printer is shown in FIG. 2. The system 100 includes an ink stick feed channel 104 with a drive train 108 to provide ink sticks 110 to a melting device 114. The melting device shown in FIG. 1 is a heated funnel that melts solid ink sticks within the funnel and acts as a reservoir for storing melted ink. The melting device may also be a melting plate that generates melted ink from solid ink sticks and then directs the melted ink into an ink reservoir for storage. The melting device 114 is coupled by a conduit 118 to a print head 120. A print engine 124 receives data from a scanner or an electronic document memory for generation of a document image. The data are processed and at least some of the data are provided to a print head controller 128. The print head controller 128 generates print head driving signals that are provided to the piezoelectric actuators in the print head 120 to eject ink from the print head onto an image substrate in a controlled manner. These components of a solid ink printer are well known.

In one embodiment of an ink stick transportation control system, an ink loss measurement circuit is configured to identify an accumulated ink mass loss of ink from an ink reservoir in a printer and to generate an ink supply replenish signal in response to the accumulated ink mass loss reaching an accumulated loss threshold. The ink loss measurement circuit may include the print head controller 128 being configured to identify an accumulated mass for the ink drops ejected from the print head and to generate an ink supply replenish signal in response to the accumulated mass for the ink drops reaching an accumulated loss threshold. Configuration for the print head controller 128 refers to programmed instructions for implementing the ink loss measurement circuit being stored in a program memory for execution by the print head controller. In this embodiment, additional hardware components are not required as the print head controller processes the data provided by the print engine for image generation so the number of ink drops ejected by the print head are known. Additionally, the mass of ink drops ejected by the print head may be ascertained from the magnitude of the signals generated for the print head or stored in the memory of the print head controller after being determined with a factory calibration procedure. Any subsequent adjustments made by operational programs or field personnel may likewise be stored in memory for the print head controller. Using the number of drops ejected and data regarding the mass of the drops ejected, the print head controller is able to identify the accumulated mass of the drops ejected by a print head. The print head controller may then compare this accumulated mass of ink lost through the print head to an accumulated loss threshold.

The comparison of the accumulated ink loss to the accumulated loss threshold is used to determine whether additional solid ink is required by the melting device 114. If the accumulated ink loss mass is equal to or greater than the accumulated loss threshold, the ink supply replenish signal is generated. In the embodiment shown in FIG. 2, the ink supply replenish signal is provided by the print head controller 128 to the print engine 124, which generates a drive motor activate signal. The drive motor activate signal may cause an electronic switch to electrically couple a drive motor 130 to an electrical power source. Alternatively, the print head controller 128 may generate the ink supply replenish signal for the drive motor 130. The drive motor includes a rotational output shaft that is coupled to a pulley 134 in the ink stick drive train 108. The drive motor activate signal enables the drive motor to be powered long enough so at least a portion of the ink stick drive train moves towards the melting device 114 in the printer. As shown in FIG. 2, the drive train 108 includes an endless belt 138 and a plurality of pulleys 134. Operating the drive motor 130 causes one of the pulleys to rotate so the endless belt 138 moves as well as the other pulleys. Thus, the upper portion of the endless belt moves towards the melting device 114. Because the ink sticks rest on the endless belt 138, they are transported towards the melting device 114.

In one embodiment, the operation of the drive motor is timed so the amount of time that the drive motor operates corresponds to a predetermined travel distance. The travel distance, as a proportion of the length of a solid ink stick, corresponds to a predetermined ink mass. Provided the ink sticks are end to end in the feed channel, operation of the drive motor for the predetermined travel distance feeds solid ink into the melting device in an amount corresponding to the predetermined mass. In one embodiment, the predetermined travel distance and corresponding predetermined ink mass result in the production of an amount of ink that is equivalent to the accumulated loss threshold. Thus, detection of an ink loss amount that is equivalent to the accumulated loss threshold results in the ink supply replenish signal being generated and the lost ink mass being replaced.

While the control program for a known print head controller and print engine may be modified to implement the ink loss measurement circuit as described above, other embodiments may be used as well. For example, the ink loss measurement circuit may include a melted ink level detector that is proximate the ink reservoir for supplying melted ink to the print head. In this embodiment, the melted ink level detector generates the ink supply replenish signal in response to the melted ink level detector detecting a melted ink level change that indicates a loss of ink reaching the accumulated loss mass. In the system of FIG. 2, the melted ink level detector is an optical sensor 140 mounted to the reservoir portion of the melting device 114. The optical sensor in this embodiment is mounted to a transparent or translucent section of the reservoir to detect light changes occurring from a level drop in the reservoir. Alternatively, the melted level may be a fluid level sensor located within an ink reservoir. As shown in FIG. 2, the optical sensor 140 provides an ink supply replenish signal to the print engine in response to the sensor detecting the fluid level in the reservoir falling below a predetermined level. In response to the ink supply replenish signal, the print engine may generate the drive motor activate signal for moving an amount of solid ink into the melting device for melting that refills the reservoir. In one embodiment, the print engine generates the drive motor signal for a timed duration as described above. In another embodiment, the replenish signal from the sensor 140 is provided to the drive motor 130 as the drive motor activate signal. In response to the level of the reservoir reaching a position that causes the sensor to change the state of the replenish signal, the drive motor is deactivated to stop the ink stick drive train. In this embodiment, the drive train continues to run until the ink level is restored to the sensor's position. Consequently, the sensor is positioned so any time delay between the melting of solid ink and the detection of the level change does not result in the reservoir or melting device overflowing.

In another embodiment, the ink loss measurement circuit may be implemented with a solid ink melting monitor that detects melting of solid ink to supply an ink reservoir and that generates a melting active signal during detection of the solid ink melting. An ink supply replenish signal generator is configured to generate the ink supply replenish signal in response to the melting active signal being generated for a predetermined period of time. This embodiment may be implemented with a configuration of the control program in the print engine 124 that times the duration of a melting operation by the melting device 114. For example, in response to the print engine 124 operating an electronic switch to provide electrical power to the melting device 114 so it is heated to the solid ink melting temperature, the print engine may time the period in which the electronic switch is maintained in this position. In response to the period reaching a predetermined time, the ink supply replenish signal is generated by the print engine to operate the drive motor and urge more solid ink carried by the drive train 108 towards the melting device 114 to replace the solid ink melted during the predetermined time period.

In another embodiment, a current sensor 144 may be used. The current sensor is a known type of sensor that detects the flow of current through a conductor. The sensor detects current in the wires supplying power to the melting device 114 for the melting of solid ink. The duration of this current flow may be timed and when the time reaches a predetermined time, the ink supply replenish signal is generated so the drive motor is operated as described above. This embodiment may be useful in printers where the heating control is performed by a processor other than the print engine. In another embodiment, the sensor may be a thermistor located proximate to a melting device to identify the melting device reaching a temperature for melting solid ink. In response to the thermistor increasing above a melting threshold, a timer is used to measure the duration of the time at which the thermistor indicates the melting device is at or above the melting threshold. When the time reaches the predetermined time, the ink supply replenish signal is generated so the drive motor is operated as described above.

While the ink loss measurement circuit has been described with reference to a single print head, an ink loss measurement circuit may be provided for each print head in a plurality of print heads. Each ink loss measurement circuit in a multiple print head embodiment is configured to identify an accumulated ink mass loss of ink from one of the melted ink reservoirs and to generate an ink supply replenish signal in response to the accumulated ink mass loss for the melted ink reservoir being monitored by the circuit reaching an accumulated threshold. As described above, the ink supply replenish signal is used to activate a drive motor for the feed channel supplying solid ink to the melting device that is coupled to the melted ink reservoir monitored by the ink loss measurement circuit. In this manner, each melted ink reservoir is independently monitored and replenished.

In operation, one of the ink loss measurement circuits is provided in a solid ink printer. While FIG. 2 shows all of the embodiments in a single illustration, only one embodiment is required for each print head in a printer. For example, if the print head controller and print engine programs are modified to accumulate an ink loss mass measurement by counting ink drops and calculating the corresponding mass, then the sensor/timer embodiments are not required. At installation, the feed channels are filled with ink sticks. Thereafter, the ink loss measurement circuit determines when an accumulated mass of ink has been used and generates the ink supply replenish signal for the corresponding melted ink reservoir. The drive motor for the corresponding feed channel is activated to move the solid ink sticks in the feed channel by a predetermined distance corresponding to the accumulated mass. A user viewing any vacancy at the insertion port then knows to continue inserting an ink stick and advancing the drive train by the length of the stick until an ink stick is occupying the insertion port. In this manner, the ink sticks in a feed channel remain contiguous and the user knows that the feed channel is filled with solid ink.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

We claim:

1. A system for controlling transportation of solid ink in a solid ink printer comprising:

an ink loss measurement circuit having a print head controller coupled to a print head, the print head controller being configured to identify an accumulated mass of ink removed from an ink reservoir in a solid ink printer as an accumulated mass for ink drops ejected from the print head and to generate an ink supply replenish signal in response to the identified accumulated mass for the ink drops ejected from the print head being equal to or greater than an accumulated loss threshold;

a drive motor electrically connected to the ink loss measurement circuit, the drive motor being configured to operate in response to the ink supply replenish signal; and an ink stick drive train operatively connected to the drive motor, at least a portion of the ink stick drive train moving towards a melting assembly in the solid ink printer in response to the drive motor operating.

2. The system of claim 1, the ink stick drive train moving a distance that corresponds to the accumulated loss threshold.

3. The system of claim 1 further comprising:

a plurality of ink reservoirs, each reservoir having an ink loss measurement circuit and each ink loss measurement circuit having a print head controller operatively connected to a print head, the print head controller being configured to identify an accumulated mass of ink removed from the ink reservoir associated with the ink loss measurement circuit as an accumulated mass for ink drops ejected from the print head to which the print controller of an ink loss measurement circuit is operatively connected and to generate an ink supply replenish signal in response to the accumulated mass of ink for the ink ejected from the print head operatively connected to the print head controller of an ink loss measurement circuit being equal to or greater than the accumulated loss threshold;

a plurality of drive motors electrically connected to the ink loss measurement circuits in a one-to-one manner, each drive motor being configured to operate in response to the ink supply replenish signal generated by the print head controller of the ink loss measurement circuit to which the drive motor is electrically connected; and a plurality of ink stick drive trains operatively connected to the plurality of drive motors in a one-to-one manner, at least a portion of each ink stick drive train moving towards a melting assembly in a plurality of melting assemblies in response to the drive motor that is operatively connected to the ink stick drive train operating.

4. A system for controlling transportation of solid ink in a solid ink printer comprising:

an ink loss measurement circuit having an ink supply replenish signal generator and a solid ink melting monitor, the solid ink melting monitor having a current sensor that is configured to detect current being delivered to a melting device in the solid ink printer that supplies melted solid ink to the ink reservoir monitored by the ink loss measurement circuit and to generate a melting active signal during detection of the current being delivered to the melting device, and the ink supply replenish signal generator being configured to generate an ink supply replenish signal in response to the melting active signal being generated by the solid ink melting monitor for a predetermined period of time;

a drive motor electrically connected to the ink supply replenish signal generator, the drive motor being configured to operate in response to the ink supply replenish signal; and an ink stick drive train operatively connected to the drive motor, at least a portion of the ink stick drive train moving towards a melting assembly in the solid ink printer in response to the drive motor operating.

5. The system of claim 4, the solid ink melting monitor further comprising:

a thermistor proximate to the melting device to identify the melting device being at a temperature for melting solid ink.

6. A system for controlling transportation of solid ink in a solid ink printer comprising:

a plurality of ink reservoirs;

a plurality of ink loss measurement circuits, each ink loss measurement circuit being operatively connected to the plurality of ink reservoirs in a one-to-one manner by a plurality of print head controllers, each print head controller in each ink loss measurement circuit being operatively connected to a print head in a plurality of print heads in a one-to-one manner and each print head controller being configured to identify an accumulated mass of ink removed from the ink reservoir operatively connected to the print head controller with reference to an accumulated mass of ink drops ejected from the print head operatively connected to the print head controller and to generate an ink supply replenish signal in response to the accumulated mass of ink removed from the ink reservoir being equal to or greater than an accumulated loss threshold;

a plurality of melting devices being positioned in a one-to-one manner with the plurality of ink reservoirs to enable each melting device to deliver melted ink to one ink reservoir in the plurality of melting devices;

a plurality of ink stick drive trains arranged with the plurality of melting devices in a one-to-one manner to enable each ink stick drive train to move solid ink to one melting device in the plurality of melting devices; and a plurality of drive motors, each drive motor being electrically connected to the plurality of ink loss measurement circuits in a one-to-one manner and being operatively connected to the plurality of ink stick drive trains in a one-to-one manner to enable each drive motor to operate the ink stick drive train operatively connected to the drive motor in response to the drive motor receiving the ink supply replenish signal generated by the ink loss measurement circuit to which the drive motor is electrically connected.

7. The system of claim 6, each ink stick drive train moving a distance that corresponds to the accumulated loss threshold.

8. A system for controlling transportation of solid ink in a solid ink printer comprising:

a plurality of ink reservoirs;

a plurality of melting devices being positioned in a one-to-one manner with the plurality of ink reservoirs to enable each melting device to deliver melted ink to one ink reservoir in the plurality of melting devices;

a plurality of ink stick drive trains arranged with the plurality of melting devices in a one-to-one manner to enable each ink stick drive train to move solid ink to one melting device in the plurality of melting devices;

a plurality of ink loss measurement circuits operatively connected to the plurality of ink reservoirs in a one-to-one manner, each ink loss measurement circuit having a current sensor and an ink supply replenish signal generator, each current sensor being operatively connected to the melting device that delivers melted ink to the ink reservoir to which the ink loss measurement circuit is operatively connected, and each current sensor being configured to detect current being delivered to the melting device operatively connected to the current sensor and to generate a melting active signal during detection of current being delivered to the melting device, and each ink supply replenish signal generator being configured to generate an ink supply replenish signal in response to the melting active signal being generated by the current sensor for a predetermined period of time; and a plurality of drive motors, each drive motor being electrically connected to the plurality of ink loss measurement circuits in a one-to-one manner and being operatively connected to the plurality of ink stick drive trains in a one-to-one manner to enable each drive motor to operate the ink stick drive train operatively connected to the drive motor in response to the drive motor receiving the ink supply replenish signal generated by the ink loss measurement circuit to which the drive motor is electrically connected.

9. The system of claim 8, the solid ink melting monitor further comprising:

a thermistor proximate to the melting device that delivers melted ink to the ink reservoir to which the ink loss measurement circuit is operatively connected and the thermistor being configured to identify a temperature for the melting device while the melting device is melting solid ink.

* * * * *